United States Patent [19]

Seymour

[11] Patent Number: 4,941,714

[45] Date of Patent: Jul. 17, 1990

[54] JEWELRY DISPLAY AND SERVICING KIOSK

[76] Inventor: Anthony Seymour, 4460 South Highland Dr., Salt Lake City, Utah 84124

[21] Appl. No.: 418,520

[22] Filed: Oct. 10, 1989

[51] Int. Cl.[5] ..... A24F 25/00

[52] U.S. Cl. ..... 312/31; 312/289; 312/7.2; 312/223

[58] Field of Search ..... 134/102; 312/285, 289, 312/31, 7.2, 223

[56] References Cited

U.S. PATENT DOCUMENTS

| | | | |
|---|---|---|---|
| 106,425 | 8/1870 | Stoelker | 312/289 X |
| 3,076,468 | 2/1963 | Beh | 134/102 |
| 3,160,451 | 12/1964 | Lewis | 312/285 X |
| 3,650,039 | 3/1972 | Harding | 312/31 X |
| 4,377,114 | 3/1983 | Fuller | 312/285 X |
| 4,433,698 | 2/1984 | Blaul | 134/102 X |
| 4,791,947 | 12/1988 | Holzberger | 312/31 X |

*Primary Examiner*—Joseph Falk

*Attorney, Agent, or Firm*—Thorpe, North & Western

[57] ABSTRACT

A jewelry display device for positioning in either free-standing condition or against a wall comprising an upright enclosure including top and bottom covers and at least two display walls having recessed shelving for supporting items of jewelry in an ornamental display. Steam cleaning apparatus is coupled at an exterior face of one of the display walls to encourage customer involvement and promotions. The device may also be complemented with a jewelry polishing wheel, safe storage compartments and various promotional features such as video display components.

11 Claims, 1 Drawing Sheet

JEWELRY DISPLAY AND SERVICING KIOSK

BACKGROUND OF THE INVENTION

1. Field of the Invention

This invention pertains to devices for display of jewelry in an attractive setting for the purpose of stimulating commercial sale. More specifically, the present invention relates to a self-standing display apparatus which provides ornamental display of jewelry in a highly elegant format and includes servicing mechanisms for cleaning and polishing jewelry, as well as providing other conveniences from a single apparatus or system.

2. Prior Art

Jewelry has traditionally been marketed through jewelry stores which offer an elegant environment characterized by fine appointments, glass cases, bright lighting, velvet display covers, and a variety of other enhancements designed to create an air of beauty and stimulate an appreciation of jewelry as an art form. As with any art form, however, it is the observer or customer who must interrupt his current activities and concerns to indulge in the finer things of life. If the customer does not avail himself of an opportunity to examine various items of jewelry, it is very unlikely that his interest level will lead to a purchase. Indeed, if the jewelry is not given adequate exposure to sufficient customers, even the finest of sales environments will be for naught.

Accordingly, persons involved with the sales of fine jewelry have been challenged with a seeming dichotomy of marketing requirements. First, the jewelry store must present an artistic and elegant environment suitable to place the customer in a proper attitude. Second, jewelry display needs to reach sufficient numbers of customers to build an awareness and desire to purchase. Unfortunately, these requirements tend to be at odds. To maximize exposure of the product, jewelry needs to be placed in high traffic areas where customer traffic flow places the consumer in visual contact with the jewelry. Such high traffic areas, however, tend to be a direct contrast to the peaceful and elegant setting which favors an interest in reflecting over fine cut stones and precious metals. Accordingly, those involved in the field of jewelry sales have been forced to choose between high exposure and prime environment. Generally, traditional approach has dictated in favor of the latter.

In an effort to gain some benefit of increased customer exposure, jewelry store windows are specially structured to catch the interest of passing traffic. Although bright lights and glittering displays are attractive, they are generally ineffective for enticing consumers to interrupt busy schedules to merely view window displays. Nevertheless, unless persons are brought to a display area, they will rarely become interested in purchasing jewelry.

Furthermore, store attendants are reluctant to approach shoppers outside the store as they view display windows. Until a customer actually enters the store, common practice is to allow the customer to make the initial expression of interest or inquiry. To approach customers at an exterior display window might discourage casual window shopping in fear of being pursued by salesmen. Therefore, the jewelry store owner is seemingly stifled from developing customer interest by (i) traditional low-key marketing and (ii) customer expectation that they should not be bothered unless they make the initial inquiry of a salesman.

OBJECTS AND SUMMARY OF THE INVENTION

It is an object of the present invention to provide a jewelry display device or system which combines the elegant beauty of conventional jewelry display with a modular format which permits positioning the display system in the midst of pedestrian traffic, such as in shopping malls and other areas of public gathering.

It is a further object of the present invention to provide means for getting the attention of passing consumers to thereby enhance awareness of the jewelry display and initiate conversation between an attendant and prospective customers.

It is a specific object of this invention to provide a modular display system for jewelry which includes various apparatus useful in providing services with respect to jewelry such as cleaning, polishing, etc.

Yet another object of the present invention is to provide a modular system for displaying and servicing jewelry wherein the system or display unit is self-contained, secure and includes necessary facilities for elegant display with full lighting, decor, storage facility, video display and safe storage.

These and other objects are realized in a jewelry display device for positioning in either free-standing condition or against a wall which the device comprises an upright enclosure including top and bottom covers and at least two display walls coupled to the top and bottom covers and having recessed shelving at exterior wall faces for supporting items of jewelry in an ornamental display. The respective display walls are joined to each other at lateral edges to form a continuous, free-standing wall which obscures view of interior wall faces and the contained area within the enclosure. A steam cleaning apparatus is coupled at an exterior face of one of the display walls and connects with steam generating means positioned within the contained area by means of a steam transmission conduit which extends to a small opening in the display wall to form a terminal end of the steam cleaning apparatus. A valve controlled outlet coupled in line with the steam transmission conduit permits an attendant to the jewelry display device to offer free cleaning services to the passing consumer, providing an incentive for the consumer to inspect displayed jewelry while his own rings or other jewelry are being cleaned. Other service aspects may be implemented within the display device such as polishing wheels, literature display and video presentations.

Other objects and features of the present invention will be apparent to those skilled in the art based upon the following detailed description, taken in combination with the accompanying drawings.

DETAILED DESCRIPTION OF THE INVENTION

Figure 1:
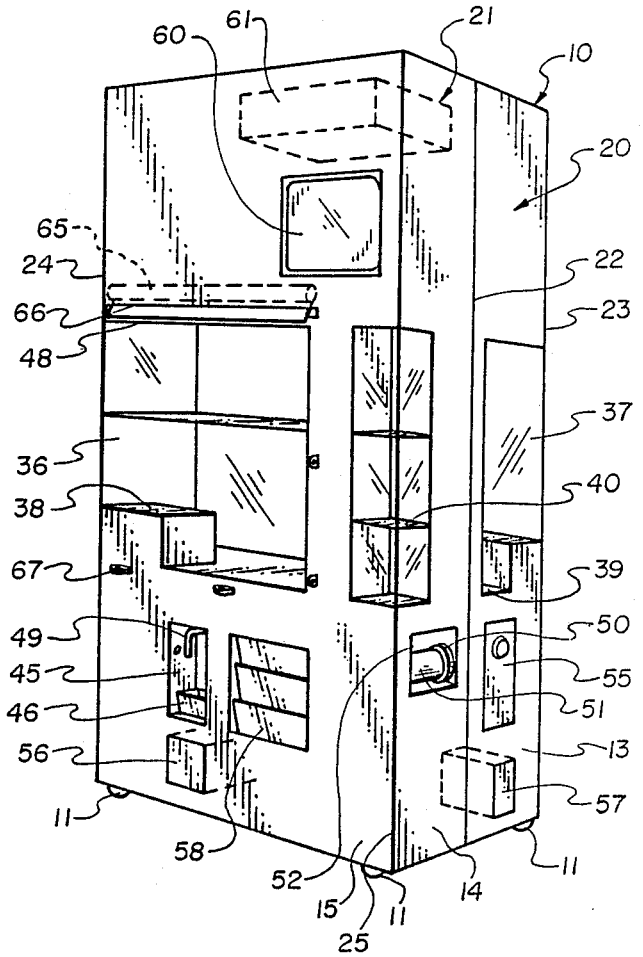
FIG. 1 shows a perspective view of one embodiment of the jewelry display device constructed in accordance with the present invention.

Referring now to the drawings:

FIG. 1 illustrates a jewelry display device 10 which is constructed in modular form and provided with castors or other types of wheels 11 to facilitate its use in either freestanding condition or supported against a wall in such places as mall walkways, general shopping areas, restaurants and virtually any area of public gathering. The display device is substantially self-contained, secure and capable of creating an air of elegance similar to the environment offered by a conventional jewelry store.

The display device includes top (not shown) and bottom covers 12 which are coupled to respective ends of lateral display walls 13, 14 and 15. The walls on back sides of the device in both figures are substantially the same as the visible wall having parallel orientation. In fact, the display device shown in the figures is actually comprised of two modular units 20 and 21 which are virtually identical and which have been placed back to back at juncture 22. Accordingly, wall edge 23 corresponds to wall edge 24 of the opposing unit 21.

Figure 2:
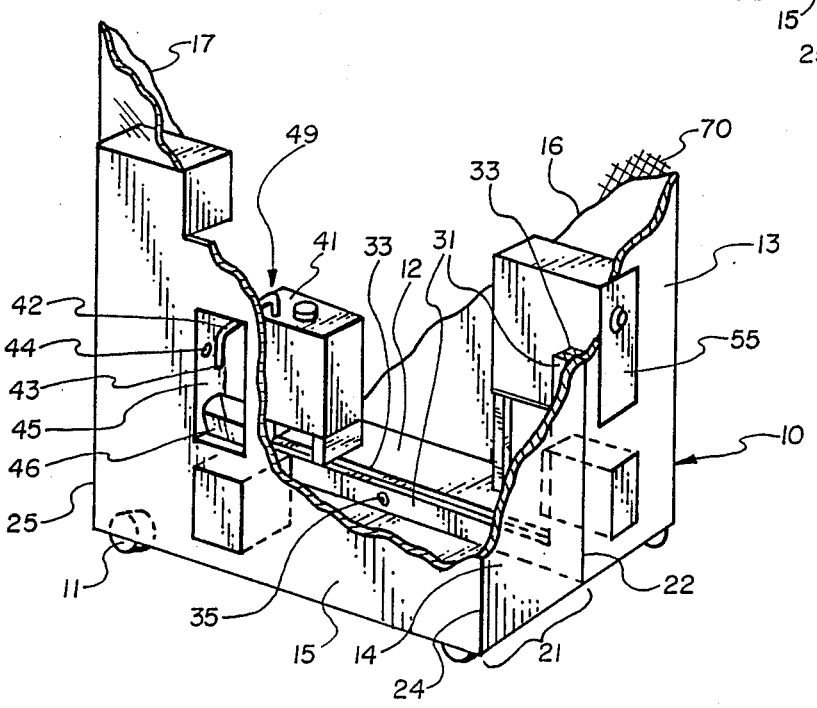
FIG. 2 shows a cut-away perspective view of a base section of the subject invention, including steam cleaning apparatus forming part of the service equipment in the display device.

This is more clearly represented in FIG. 2 which illustrates the back to back orientation and junction line 22 in cutaway view. Except for accessories and servicing equipment which require only one unit per kiosk system, wall 16 corresponds with wall 15 and wall 17 corresponds with wall 13. Accordingly, in this embodiment, the device 21 is formed in a rectangular configuration with three display walls 14, 15 and 17, two of which 14 and 17 are positioned in opposing, parallel orientation. The third, dominant wall 15 is coupled at corresponding edges 24 and 25 of the two parallel walls 14 and 17.

A fourth side 30 of the device 21 is an open wall bounded by perimeter structure 31 which is contained within a single plane and configured for abutting contact against a similar open wall on the second device 20, likewise bounded by perimeter structure 33. Accordingly, the two units 20 and 21 are positioned back to back and interlocked with a nut and bolt 35 or some other interlocking means to form a rigid, free standing unit of rectangular configuration wherein the respective three display walls form the exterior wall enclosure of the device. Alternatively, the open side of a single unit can be positioned at a support wall with the display walls of the unit open to view.

This wall structure may be fabricated of plywood and overlaid on the exterior face with paint, plastic or metallic finish. Exterior glass facing 36 and 37 provides enclosure for the recessed display shelves 38, 39 and 40. These windows are hinged at one edge and provided with a lock and latch to control access to the displayed jewelry. A halogen lighting system is recessed into the ceiling 48 of each recessed shelf and provides intense light to enhance the glitter and beauty of the product.

A principal feature of the present invention is provisions of a steam cleaning system as part of the display device. This system comprises a steam cleaning apparatus 49 coupled at an exterior face of one of the display walls through a small opening therein which communicates with the closed, contained area. Steam generating means 41 is positioned within the contained area to provide the source of steam for the steam cleaning system. The steam generating means 41 may be any commercial device for providing low pressure steam and is typically powered by an electric heating element. Interconnecting conduit 42 is coupled to the generating means 41 and extends through the small opening to provide an applicator end 43 which emits the steam for cleaning usage. A valve controlled outlet 44 is coupled in line with the steam transmission conduit 42 to enable controlled release of steam as part of the cleaning apparatus. These components are housed within a recessed compartment 45 within an exterior face of one of the display walls as illustrated in the figures. In addition to housing the steam cleaning apparatus, each compartment provides a support base for a water collection pan 46.

By providing a steam cleaning apparatus as part of the jewelry display device, major advantages are realized. Because the device may be positioned within the major traffic flow of consumers, there is direct exposure to potential customers who pass by. The present invention provides opportunity to offer such passing customers free cleaning of their jewelry. The cost of this service is nominal; however, it places the customer in a waiting position at the jewelry display device. Natural inclination will cause the customer to inspect the various jewelry displays while waiting for return of the jewelry being cleaned. Simply stated, the steam cleaning apparatus provides the incentive for the consumer to interrupt an otherwise busy schedule to obtain a free cleaning service. In this state of mind, the customer does not feel pressured or intimidated. The elegant display format of the display system provides a pleasant and relaxing environment which contributes to an interest for inspecting the displayed jewelry. Therefore, this steam cleaning apparatus is an integral part of the subject display device because the two components work together to do what neither could accomplish separately. In this sense, synergistic benefit arises wherein the value of the inventive system exceeds the combined value of either component in separate usage.

Other features are included to provide convenience and further complement the commercial effectiveness of reaching the consumer. For example, a jewelry polishing wheel 50 and attached drive motor 51 are mounted within a recessed compartment 52. This may be used to provide additional services of interest to the consumer, also extending the waiting period while the jewelry is being cleaned and polished. This additional waiting period provides further opportunity to inspect display jewelry and arouse interest in purchasing. Also provided within the modular system 10 is a safe repository 55 which can be used to secure valuable jewelry. Slidable drawers 56 and 57 are mounted within the display walls for storing materials associated with the jewelry display device. These drawers are recessed into the contained area and are configured such that the drawer face closes flush with the exterior face of the wall. By providing a matching finish, the drawers may be made hardly noticeable.

By adding a television screen 60 and video playback equipment 61, the jewelry display device 10 provides audio and visual media to further attract and interest consumers. Video presentations displaying the various jewelry items and their benefits and features add to the entertainment and promotional aspect of the display device. Also provided are display slots 58 for holding literature and other promotional materials for direct access by customers. In this manner, a single attendant may provide the full support necessary to maintain operation of the display system. The roll of the attendant would be to assist in cleaning and polishing jewelry, answering questions and taking orders. The display device itself shows the jewelry and related items, with the video providing explanation of a general nature. Because of the economy of such a system and single attendant, proliferation of these units throughout malls, restaurants and other places of public gathering is feasible. In addition to the promotional aspects of the present jewelry display device, the present invention is adapted for secure storage when not in use. Specifically, the walls of the display device may be reinforced with steel, mesh or other reinforcing materials 60. High strength plastic such as KEVLAR (TM) or metal facing can be used at the exterior surface of the display panels to provide protection against unauthorized access. In addition, large display windows 36 and 37 can be covered with a drop cover 65 which may be stored in roll-up configuration within the contained area. A slotted opening allows the cover to be pulled from its stored position. Fastening means 67 enable secure attachment of the cover over the display windows. This cover can likewise be reinforced for enhanced security.

The physical size of the unit may vary; however, a suitable size of 4 feet×2 feet for each unit is practical. The combined units shown in the drawing therefore measure 4 feet×4 feet. This display device occupies only 16 sq. feet of floor space but offers a jewelry display system which is comparable to stores of 500 sq. feet or more, displaying as much as 300 pieces of jewelry.

It will be apparent to those skilled in the art that other modifications may be envisioned which remain within the scope of the present invention. For example, the device can be modified to include a telephone or satellite FM ordering system in combination with an interactive video. The video promotion screen 60 can be coupled to an interactive touch screen driver or remote control console for customer input. Accordingly, the foregoing examples are not to be construed as limiting the scope of the subject invention, except as provided in the following claims.

I claim:

1. A jewelry display device for positioning in either freestanding condition or against a wall, said display device comprising:

an upright enclosure including top and bottom covers and at least two display walls having exterior and interior wall faces coupled to the top and bottom covers and having recessed shelving at the exterior wall faces for supporting items of jewelry in an ornamental display, said display walls being respectively joined to each other at lateral edges to form a continuous, free-standing wall which obscures view of the interior wall faces of the enclosure from an exterior location;

steam cleaning apparatus coupled at an exterior face of one of the display walls, said apparatus including a small opening communicating with the enclosed contained area;

steam generating means positioned within the contained area for generating a source of steam under pressure;

steam transmission conduit coupled to the generating means and extending through the small opening to provide an applicator end for the steam cleaning apparatus;

a valve controlled outlet coupled in line with the steam transmission conduit for releasing steam as part of the cleaning apparatus.

2. A jewelry device as defined in claim 1, further comprising a recessed compartment within an exterior face of one of the walls, said compartment including the steam cleaning apparatus and further including means therein for collecting water.

3. A jewelry device as defined in claim 1, further comprising a jewelry polishing wheel coupled to an exterior face of one of the display walls and means for rotating the wheel to facilitate its use for cleaning jewelry.

4. A jewelry device as defined in claim 1, further comprising a safe repository mounted to one of the display walls with an access door lockably attached to the safe at an exterior face of the wall.

5. A jewelry device as defined in claim 1, wherein the display walls include at least one slidable drawer mounted therein for use in storing materials associated with the jewelry display device, said drawer being recessed into the contained area of the display walls with its exterior drawer face configured to close to a flush condition with the exterior face of the wall and being finished to match the surrounding exterior wall face for substantially concealing the drawer from casual view.

6. A jewelry device as defined in claim 1, further comprising an overhead system of halogen lights coupled over the recessed shelving within the display walls and oriented to direct emitted light downward onto displayed jewelry.

7. A jewelry device as defined in claim 1, wherein the display walls are reinforced with steel for increased security against unauthorized intrusion.

8. A jewelry device as defined in claim 1, further comprising a drop cover adapted for attachment to the exterior face of the display walls over the display shelves and including reinforcing material disposed across the cover for restricting access through and damage to the cover.

9. A jewelry device as defined in claim 1, further comprising a video opening in the display wall adapted to receive a television screen, said device including video equipment mounted within the contained area and coupled to the screen to enable use of a video display which can be viewed from outside the display device.

10. A jewelry device as defined in claim 1, wherein the device is formed in a rectangular configuration with at least three display walls, two of said display walls being positioned in opposing, parallel orientation with a third wall coupled at corresponding edges of the two parallel walls.

11. A jewelry device as defined in claim 9, wherein a fourth side of the rectangular configuration is an open wall bounded by a perimeter structure contained within a single plane and configured for abutting contact against a similar open wall on a second device of common rectangular configuration, thereby enabling the juxtaposed positioning of two units with three display walls respectively to form a rectangular display device composed of the two smaller display devices, and further including means for interlocking the two devices into a single, free-standing unit for positioning in an open walkway.

* * * * *